US006095154A

United States Patent [19]

Robinson

[11] Patent Number: 6,095,154

[45] Date of Patent: Aug. 1, 2000

[54] TOOL FOR THE REMOVAL OF BRAIDS IN HAIR

[76] Inventor: Angela Mae Robinson, 1310 Westmont, Campbell, Calif. 95011

[21] Appl. No.: 09/249,714

[22] Filed: Feb. 12, 1999

[51] Int. Cl.[7] ..... A45D 24/00; A45D 7/02

[52] U.S. Cl. ..... 132/219; 132/212; 132/147

[58] Field of Search ..... 132/212, 200, 132/219, 107, 109, 113, 114, 148, 147

[56] References Cited

PUBLICATIONS

Xerox Copy of "De–Braider" Tool, Manufacturer: Chili–Pik Enterprises. Packaging indicates "Patent Pending".

*Primary Examiner*—John J. Wilson

*Assistant Examiner*—Robyn Doan

*Attorney, Agent, or Firm*—Peter S. Zawilski

[57] ABSTRACT

A tool for unbraiding a hairstyle allows the user to separate the braid strand. In one example embodiment, the tool has a handle sufficiently large for the user to grasp and pull the tool through the braided hair strand. As the tool is pulled through the hair strand, the probe penetrates the braid and separates it. The curvature of the probe defined at a bend, retains the hair and prevents the braid from slipping out of the tool so that the braided strands can be separated.

4 Claims, 11 Drawing Sheets

TOOL FOR THE REMOVAL OF BRAIDS IN HAIR

FIELD OF INVENTION

The present invention generally is directed to the hairstyling industry. In particular, the present invention is a tool that expedites the undoing of braids in a client's hair during a hairstyle change.

BACKGROUND OF INVENTION

The maintaining of a hairstyle may be a significant aspect of an individual's day-to-day activities. As individuals are unique, so are the multitude of ways in which one could style and manager his/her hair. With the multitude of hairstyles available, those involving the tying of hundreds if not thousands of braids present a challenge to the stylist. Much effort may be expended in cleaning the hair, arranging the strands, and braiding the strands. It is not unusual for a given style to require several hours or more to complete.

In one technique, often referred to as "Box Braids" or "Individual Braids" separate braids are woven and are intended to cascade off the scalp. The cascaded braids behave similarly to loose hair in that each braid can be styled as though it were an individual strand. For example, topknots, French rolls, and ponytails can be done with individual brands. Other braid styles such as "Micro Braids" and "Casamas" are created with the individual braid.

Depending upon the style chosen, the stitch of the braid can vary. A tight stitch may be required when doing a Casamas. A very loose stitch may create a more free-flowing braid.

After spending several hours with his/her stylist, having completing the braiding, it is not uncommon for the person to wear the styled hair for a number of weeks or months. When the time arrives, the person may desire to redo his/her braids or to remove them altogether he/she may require several hours to unbraid, straighten, and clean the hair. Much of the time often is taken up with the task of unbraiding the many strands. The removal of the braids often involves use of a "stylist" comb with a long, tapering to a pointed handle. The pointed end of the handle is put in the braid and the stylist exerts force to pull apart the braid. For example, in a three-strand braid, the stylist puts the comb handle in the area at where the three strands overlap and exerts a pulling force to loosen and unravel the braid. Although, this technique is successfully in removing the braids it suffers from a number of shortcomings. Considerable time is spent in the removal process. The design of the comb may contribute to the fatigue of the stylist and result insufficient control. To prevent the unintended breakage of hair or injury to the scalp. The comb may not have sufficient strength and resilience to stand the rigors of pulling the hair and itself may be damaged. To start the removal of extremely tight braids, the stylist may often have to improvise and use a tool not intended for hair, such as a toothpick.

Accordingly, there is a need to be able to unbraid and restyle a person's hair that minimizes breakage of the hair, reduces fatigue of the stylist, increases the productivity of the hairstyling process.

SUMMARY OF INVENTION

To facilitate the removal of hair braid strands, one embodiment of a unbraid unknotting tools comprises a handle and a probe having a tip and a base. The base of the probe is attached to the long side of the handle. The probe is sufficiently tapered to penetrate and separate a hair braid strand and has sufficient curvature to retain the hair braid strand in the braid unknotting tool as it is pulled through.

In another embodiment, a braid unknotting tool comprises a cylindrical handle having a length and an outside circumference, a top and a bottom and a side, the length and circumference sufficient for a hand to grasp the tool. The side of the cylindrical handle has screw threads of a first diameter. A receptacle is defined within the tope of the cylindrical handle having an inside circumference less than the outside circumference. The depth of the receptacle is less than the length of the handle. Screw threads are defined within the inside circumference of the receptacle. An end-cap having a circumference and threads corresponding to the threads and inside circumference of the receptacle, enables the end-cap to screw into the receptacle. A probe having a base of a first diameter and threads corresponding to the screw threads in the handle enables the probe to screw into the handle. The tip has sufficient taper to penetrate and separate a hair braid strand and sufficient curvature defined in a bend to retain the hair braid strand as the braid unknotting tool is pulled through the hair braid strand.

The above summary of the present invention is not intended to represent each disclosed embodiment, or every aspect, of the present invention. Other aspects and example embodiments are provided in the figures and the detailed description that follows

BRIEF DESCRIPTION OF THE DRAWINGS

The invention may be more completely understood in consideration of the following detailed description of various embodiments of the invention in connection with the accompanying drawings, in which.

Figure 1A:
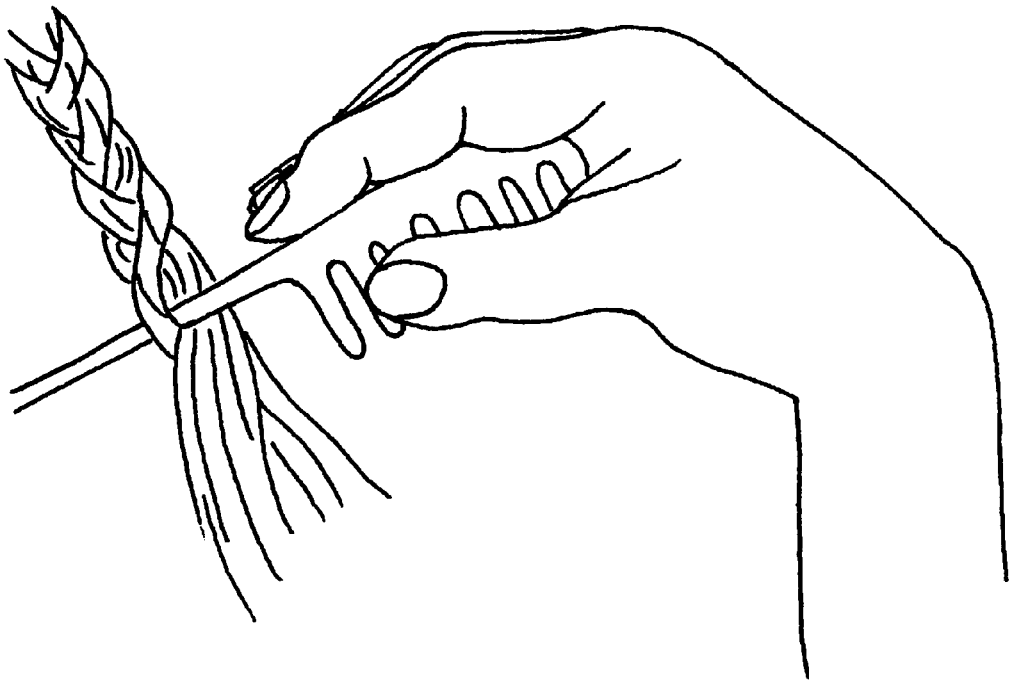
FIGS. 1A–1C illustrate the removal of braids with the handle and tines of a stylist comb and a toothpick as an examples of conventional techniques.

While the invention is susceptible to various modifications and alternative forms, specific embodiments thereof have been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

The client decides to change his/her particular hairstyle that had been braided by the hairstylist. For example, a tool the stylist may use is the long-handle of a "stylist" comb and attempt to remove the braids. The stylist will have some success although the process may be slow going. For smaller, tighter braids, the tines of the comb may be a useful solution. Perhaps, a toothpick may be useful to begin taking apart a braid. The goal is to remove the braids to rework the hair into a different style. Typically, 4 to 5 hours is required to remove braids on an average head. Of course, the time can vary depending upon a given style and the individual.

In an example embodiment of the present invention, a tool is fashioned with a sufficiently large handle for stable grip. Upon one end of the handle is a rigid, tapered, curved probe. The handle enables the user to use the whole hand and arm to provide the pulling force necessary to unbraid the hair. Rigidity of the probe prevents flexion as with prior art tools. Tapering of the probe toward its tip allows the tool to penetrate and separate the braid with a single stroke. Curvature of the probe keeps the hair braid from slipping out of the tool as the user applies a stroke force that is parallel and downward with respect to the hair.

The tapering and curvature of the probe approximates the shape of birds' beaks. In one example embodiment, the probe has a shape similar to that of an eagle's beak. In another example embodiment, has a shape similar to that of a curlew or a snipe, a long, thin and slightly curved beak.

In an example hairstyle, a person using the tool, the time needed to unbraid the hair is approximately 25% of time of conventional techniques.

Figure 1B:
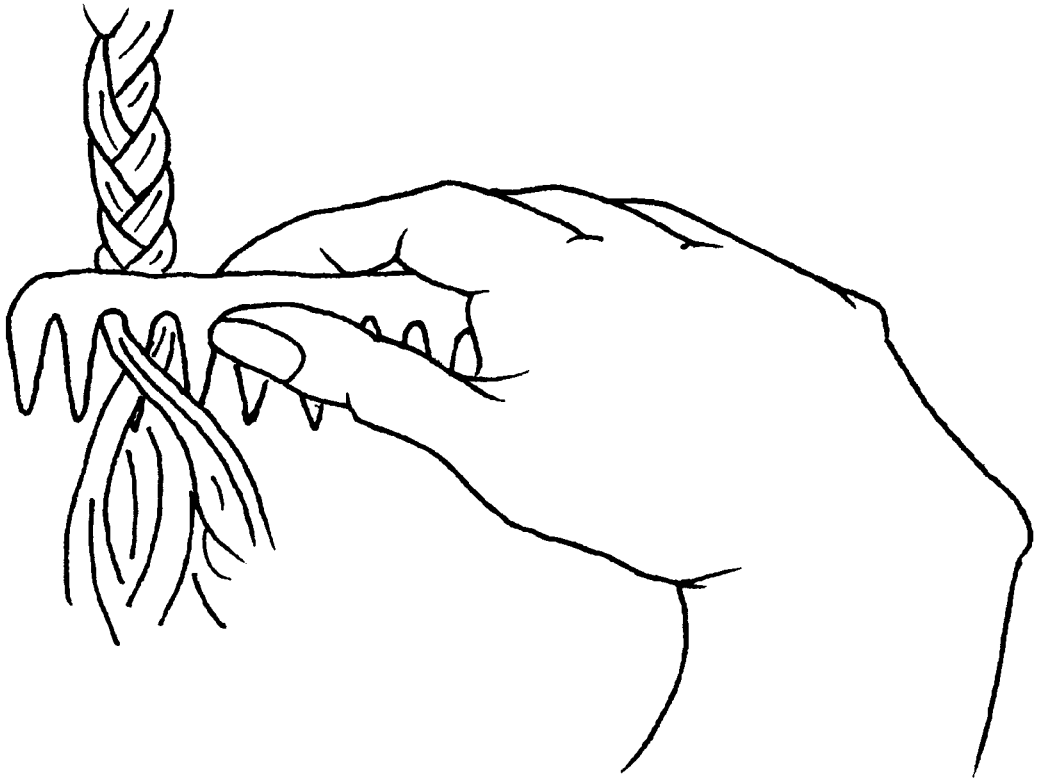
Figure 1C:
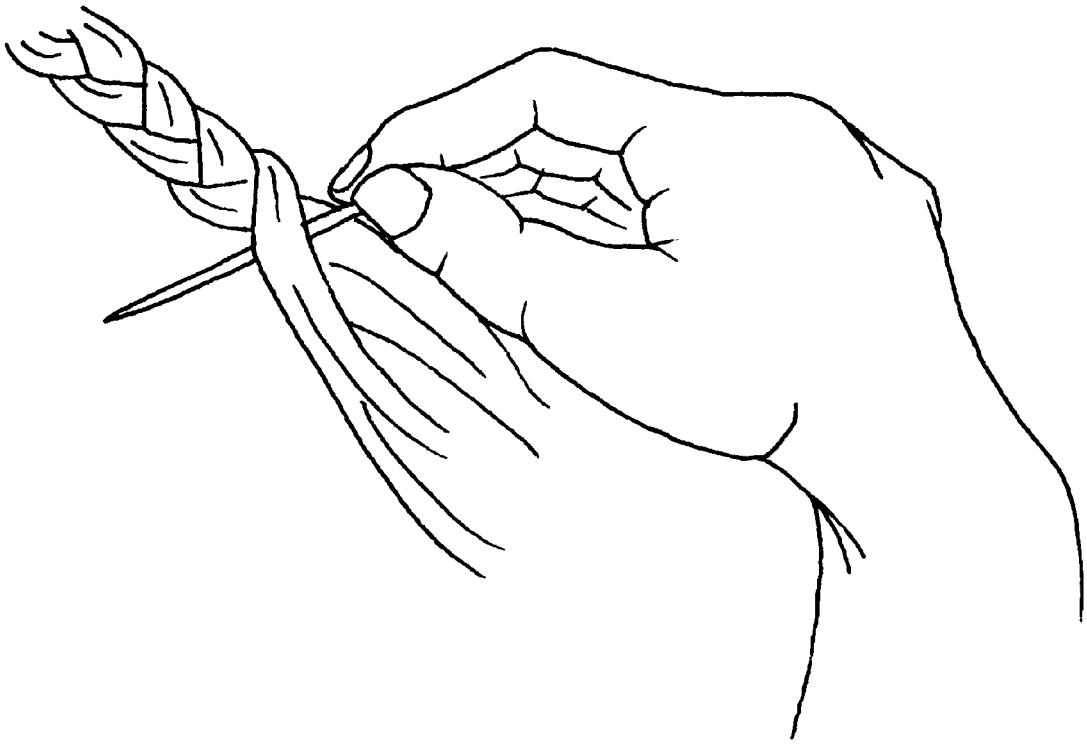

Referring to FIGS. 1A–1C, the prior art tools used to remove the hair braids are problematic. The user cannot obtain a very strong grip in that these tools are can usually only be held by the fingers. In addition, these tools may not have sufficient strength to do the job.

Figure 2A:
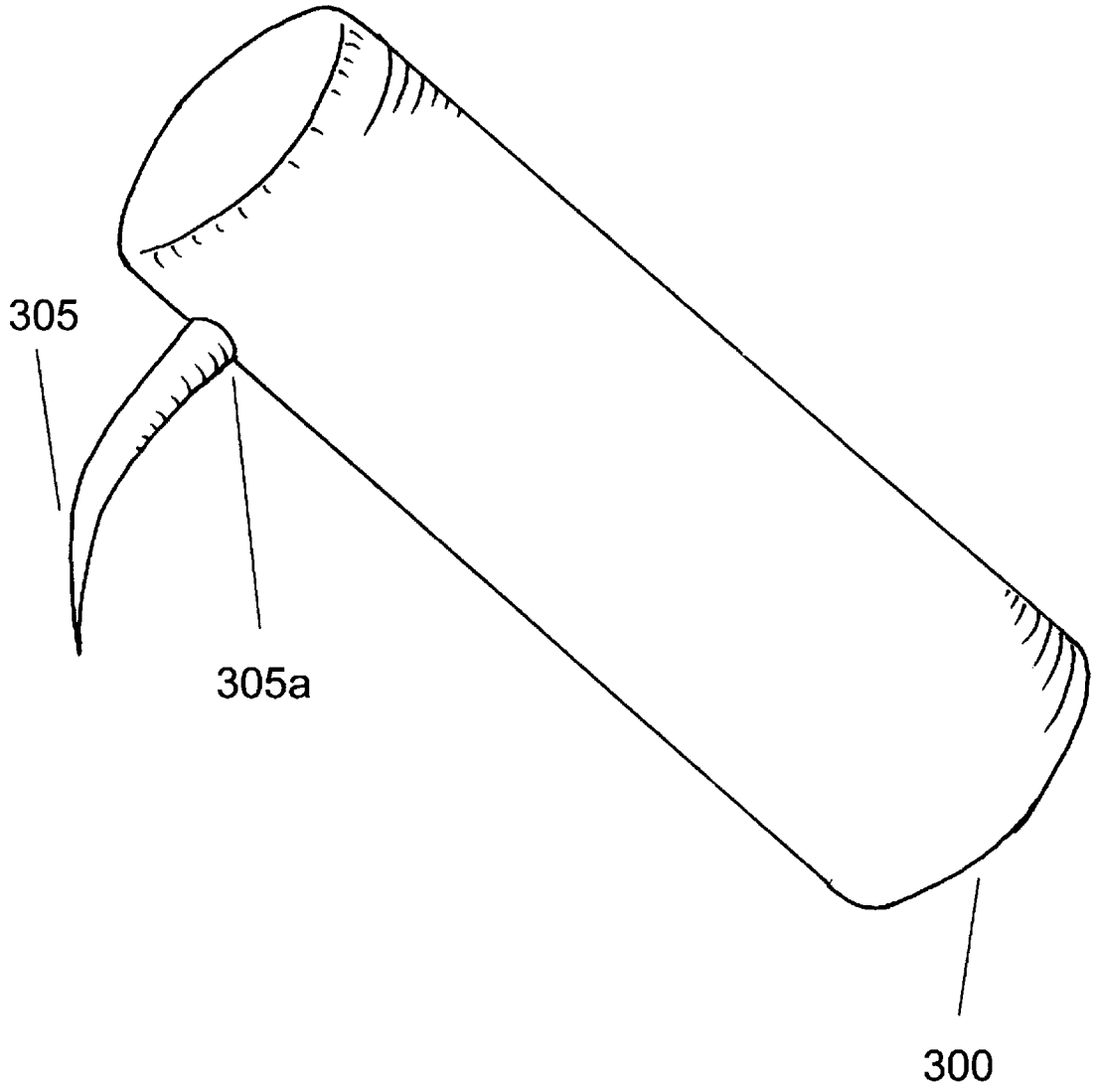
FIG. 2A illustrates an embodiment of an unbraiding tool having a "snipe's beak" tip according to the present invention.

FIG. 2A illustrates an example embodiment according the present invention. The unbraiding tool has a handle 300 to provide a grip. A tapered, slightly curved tip 305 is fixedly attached to a cylindrically shaped handle 300 at one end 305*a*. The tip can be attached by drilling a hole at 305*a* of a diameter that is slightly smaller than the diameter of the tip 305. The probe is forced into the hole 305*a* and positioned so that the tip 305 curves downward toward the bottom of the handle 300. Frictional forces retain the tip 305 in the handle 300. The depth of the hole can range from one quarter to one half of the diameter of the handle. Materials suitable for the handle 300 include wood, plastic, or metal. Conventional manufacturing techniques compatible with the handle material used and the tip may be used to construct the tool.

Figure 2B:
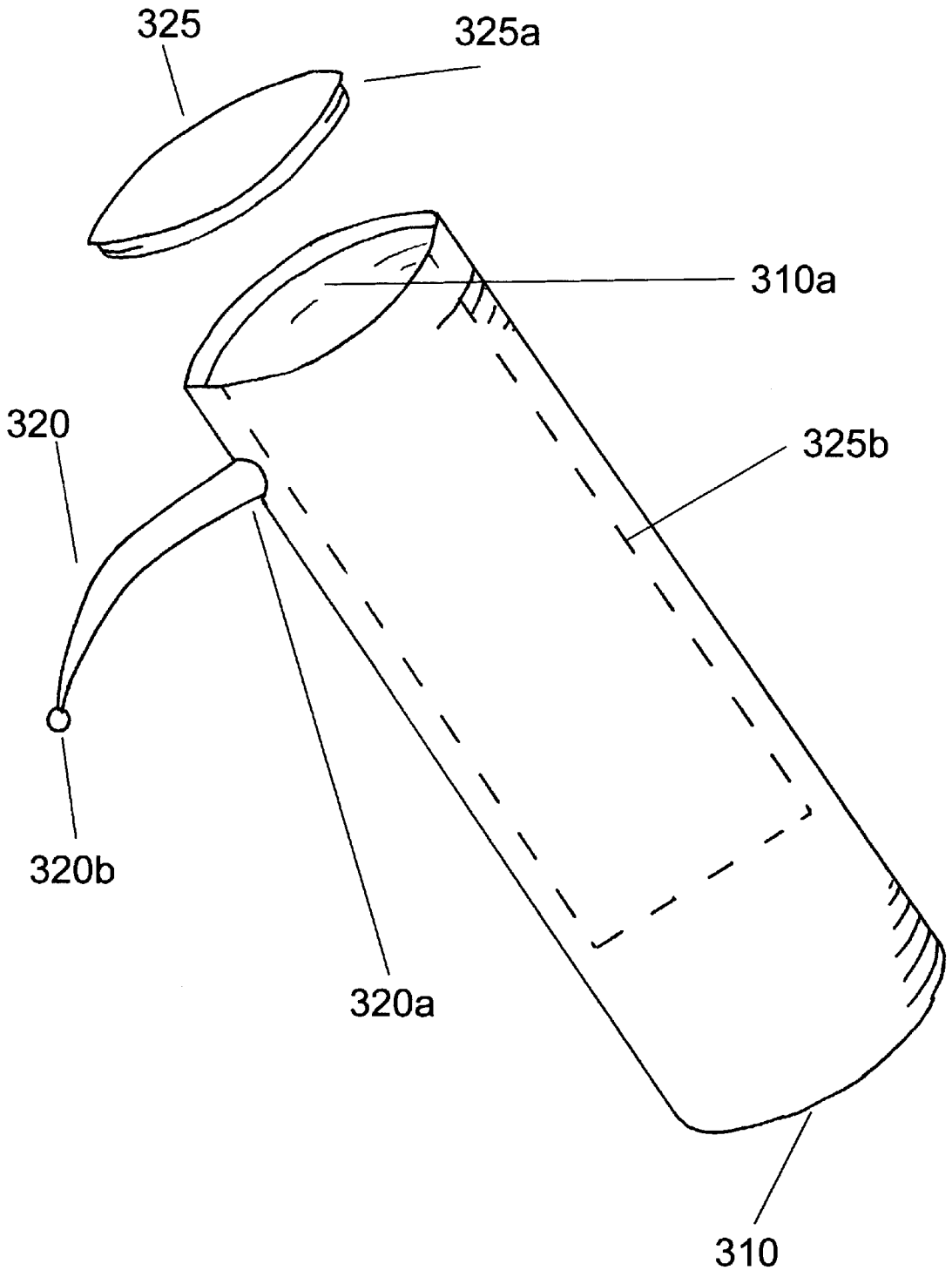
FIG. 2B illustrates another embodiment of an unbraiding tool with a removable tip and a storage chamber according to the present invention.

In another example embodiment according to the present invention, FIG. 2B depicts an unbraiding tool similar in appearance to that of FIG. 2A. However, the handle 310 is a hollowed-out cylinder with a threaded cap 325 that will screw on to the handle end that has compatible threads 325*a*. To facilitate the removal of the threaded cap 325, the cap may have a slot defined in the diameter of it enabling a screwdriver or a coin to grip the cap so that it can be screwed on or off. The tip 320 is threaded on one end and screws into compatible threads 320*a* defined in the handle 310. Additionally, the tip 320 has a spherical end 320*b*. The spherical end 320*b* reduces the sharpness of the tip while maintaining its ability to penetrate and separate the braid strand. With the handle 310, spare tips can be stored for safekeeping in a storage area 325*b*. Spare tips may include tips with threaded bases of the style depicted in FIG. 2A or FIG. 2B. The handle may be made of a suitable metal alloy of sufficient thickness to provide enough screw depth for the tip and enough rigidity to construct a sufficiently strong handle. In addition, the choice of alloy will affect the weight. Some alloys may be comprised of aluminum, titanium, steel or combinations, thereof. An example embodiment of the tool may use an alloy of stainless steel.

In another example embodiment (not illustrated), storage area 325*b* may be defined in any suitably strong material other than metal. For example, a wooden or plastic handled tool may have a hole drilled in it. The threaded cap 325 used to close the storage receptacle may be substituted by a stopper (e.g., a cork) fashioned to fit nearly flush with the end of the handle. Threads 310*a* would no longer be needed to secure the stopper.

In yet another example embodiment, rather than using a threaded cap 325, the cap may be attached to the handle with a spring-loaded hinge. The user "pops" open the top to deposit or remove tips. The spring-load hinge has sufficient force to keep the receptacle closed while the tool is used. For a more secure closure, a latch may also be included. The methods for building and attaching spring hinges and latches are well known in the manufacturing art.

Figure 2C:
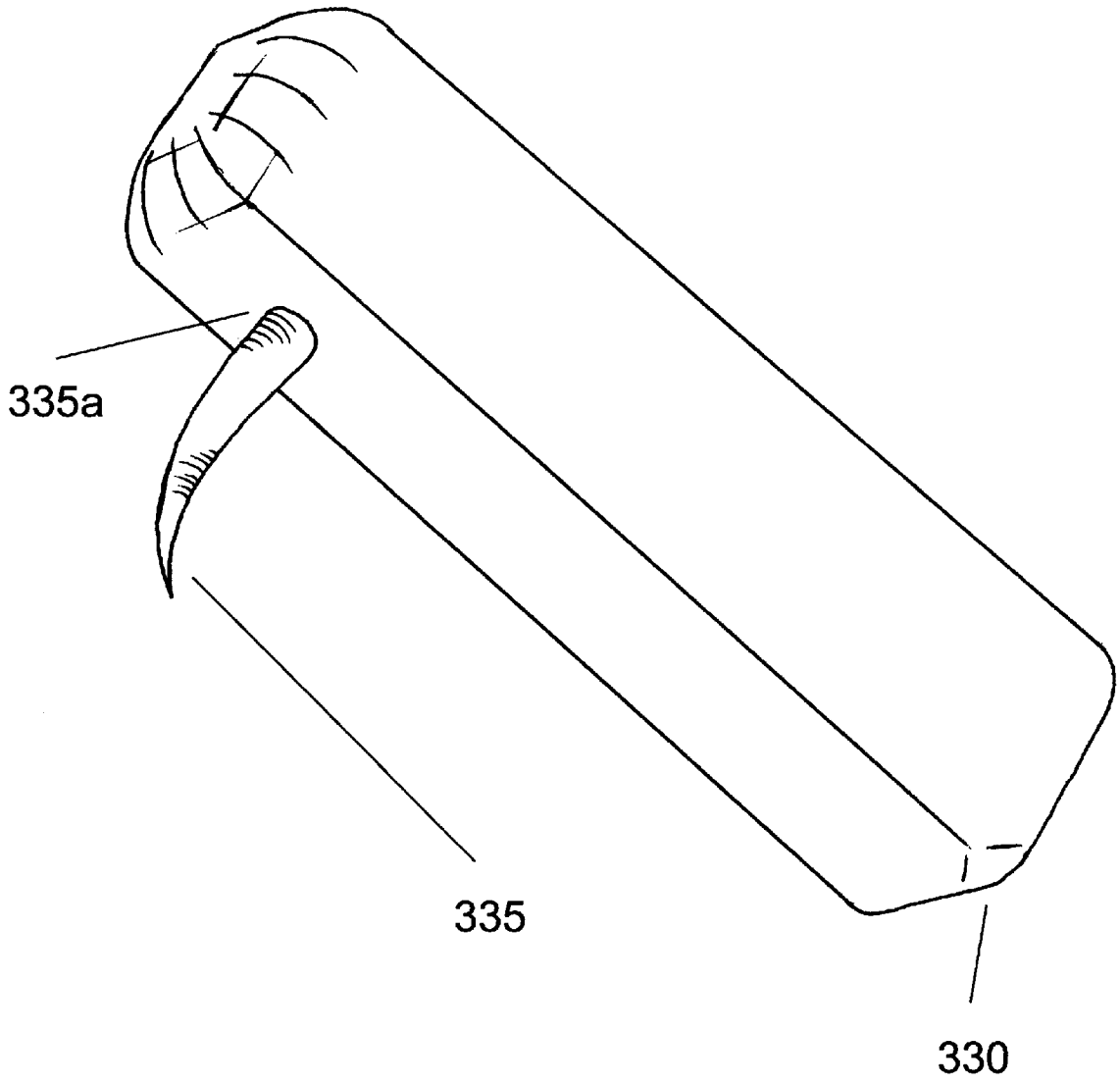
FIG. 2C illustrates yet another embodiment of an unbraiding tool with a "rectangular" shaped handle.

FIG. 2C illustrates yet another embodiment of the present invention. In an example tool, handle 330 consists of a rectangular shape whose corners are filleted. Tip 335 is attached at 335*a* as done in FIG. 2A.

Figure 2D:
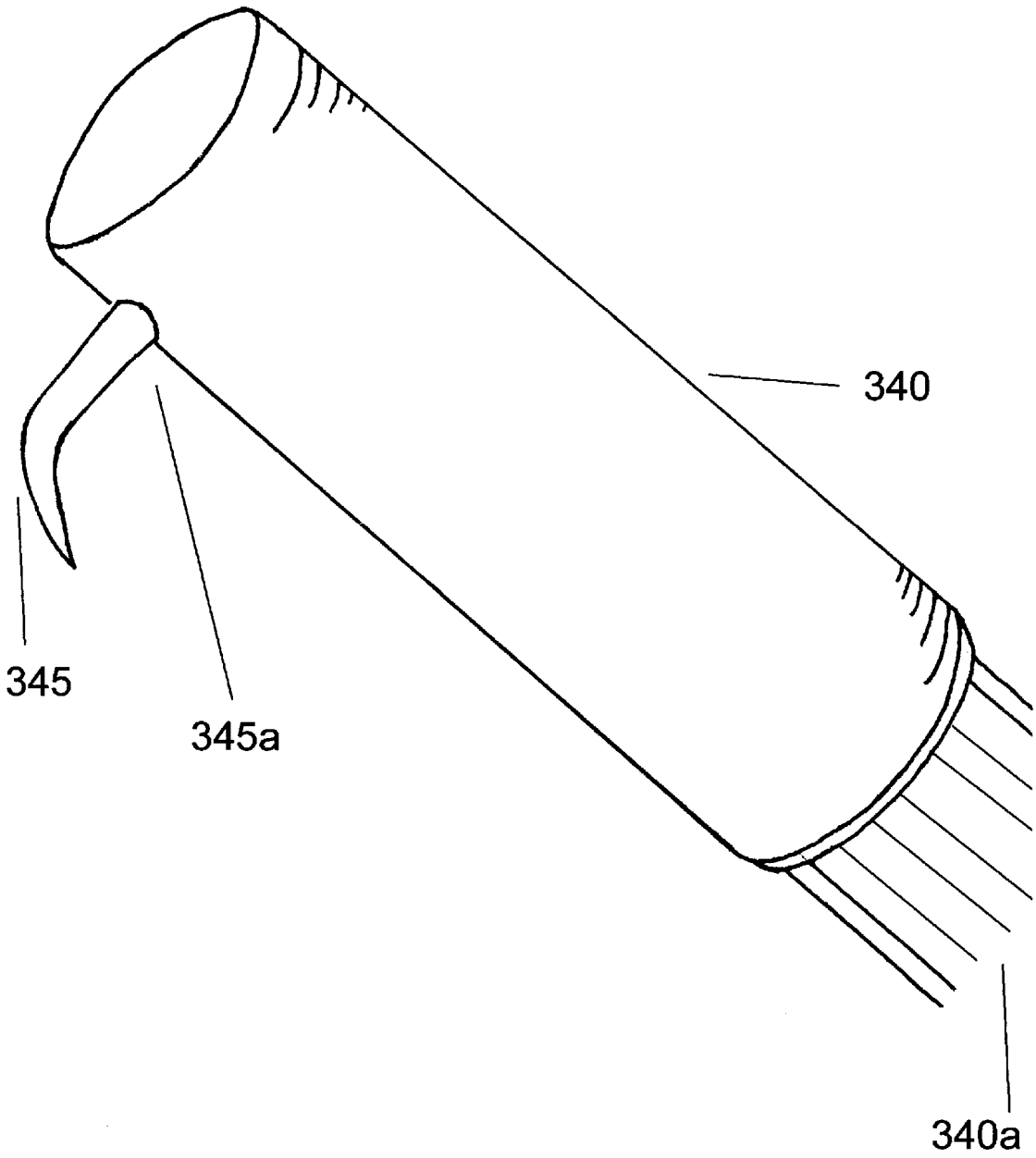
FIG. 2D illustrates yet another embodiment of an unbraiding tool with a "cagle's beak" tip and an integral comb attached the tool.

FIG. 2D illustrates yet another embodiment of the present invention. Handle 340 has an "eagle-beak" shaped tip 345 attached at 345*a*. A comb 340*a* attached to the bottom of the handle provides a means for combing out the hair as the braids are separated.

Figure 2E:
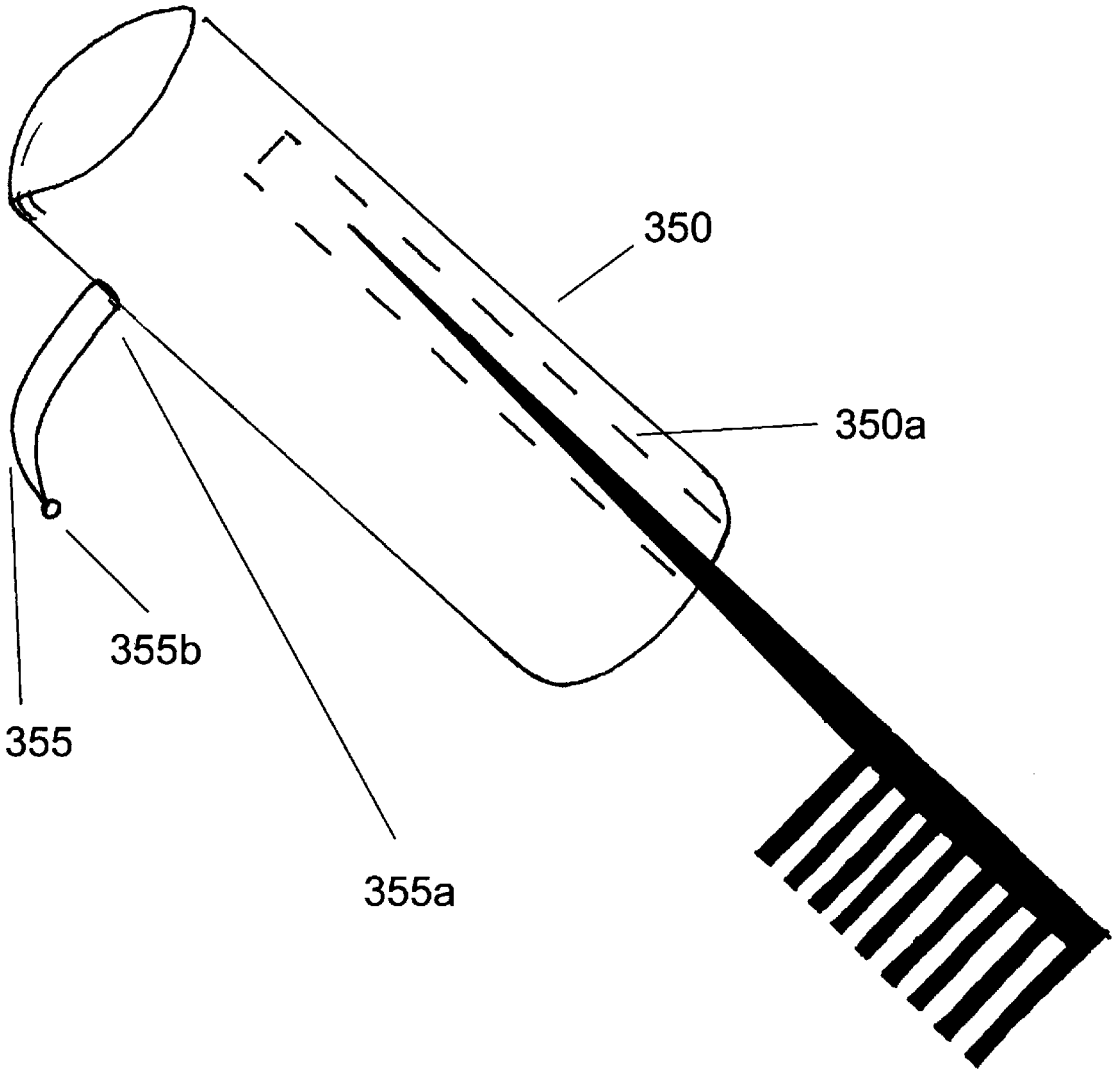
FIG. 2E illustrates yet another embodiment of an "eagle's beak" unbraiding tool with a recess to enable storage of a "stylist" comb.

FIG. 2E depicts a similar unbraiding tool with the "eagle-beak" tip 355 attached at 355*a* on handle 350. A hole 350*a* is drilled into the bottom of the handle to provide a means for holding a stylist's comb within reach of the user.

Figure 3A:
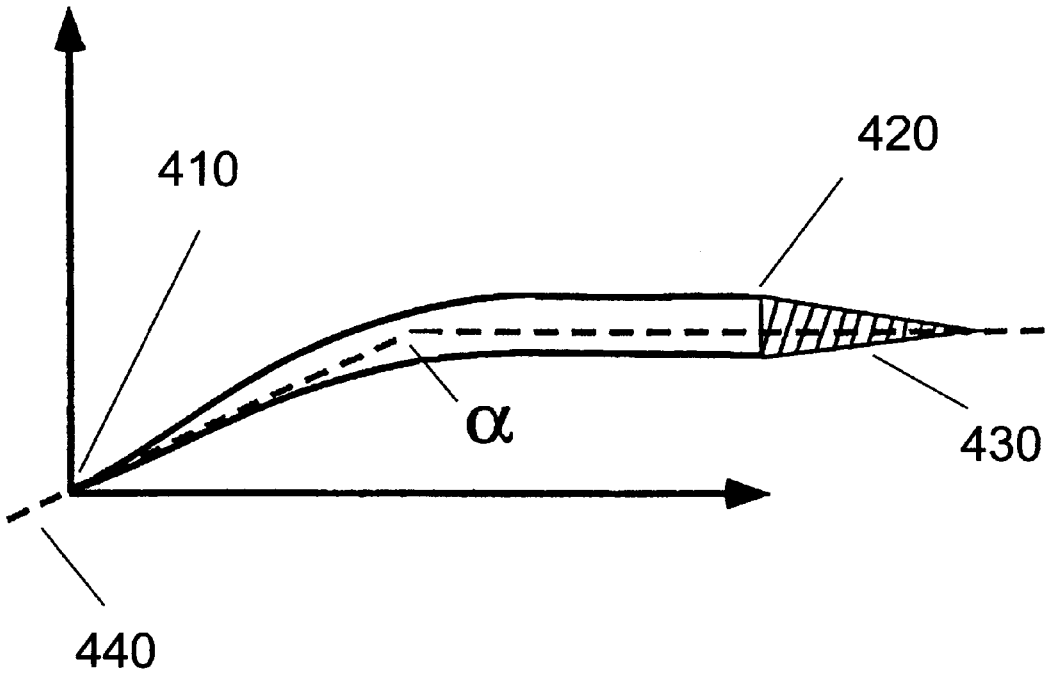
FIGS. 3A–3B illustrate side-views of example unbraiding tips and their degree of bend as used in embodiments shown in FIGS. 2A–2E according to the present invention.

FIG. 3A illustrates an example embodiment of a tip used in the present invention. In an example manufacturing process, unbraiding probe 400 may be fashioned from a conical tapered metal piece having an overall length of in the range of approximately 4 cm to 7 cm. The base 420 is about 3 mm to 5 mm in diameter. The tip 410 has a diameter in the range of approximately 0.5 mm to 2 mm. The tapered metal piece has a bend approximately half-way between the tip 410 and 420. Dashed-line 440 defines the angle $\alpha$ the bend. The angle is made about 2.5 cm to 3.5 cm from the base 420. The angle $\alpha$ ranges from approximately 135° to 170° with respect to the base as illustrated by the dashed-line 440. Tapering opposite from the base 420, may be self-tapping screw threads 430 to enable the unbraiding tip to be threaded into a handle. The screw threads 430 may also be an unthreaded nail-point enabling the tip to be driven into a wooden or plastic handle and frictionally held. In this example embodiment, the bird beak shape approximated by the probe is that of a snipe.

Figure 3B:
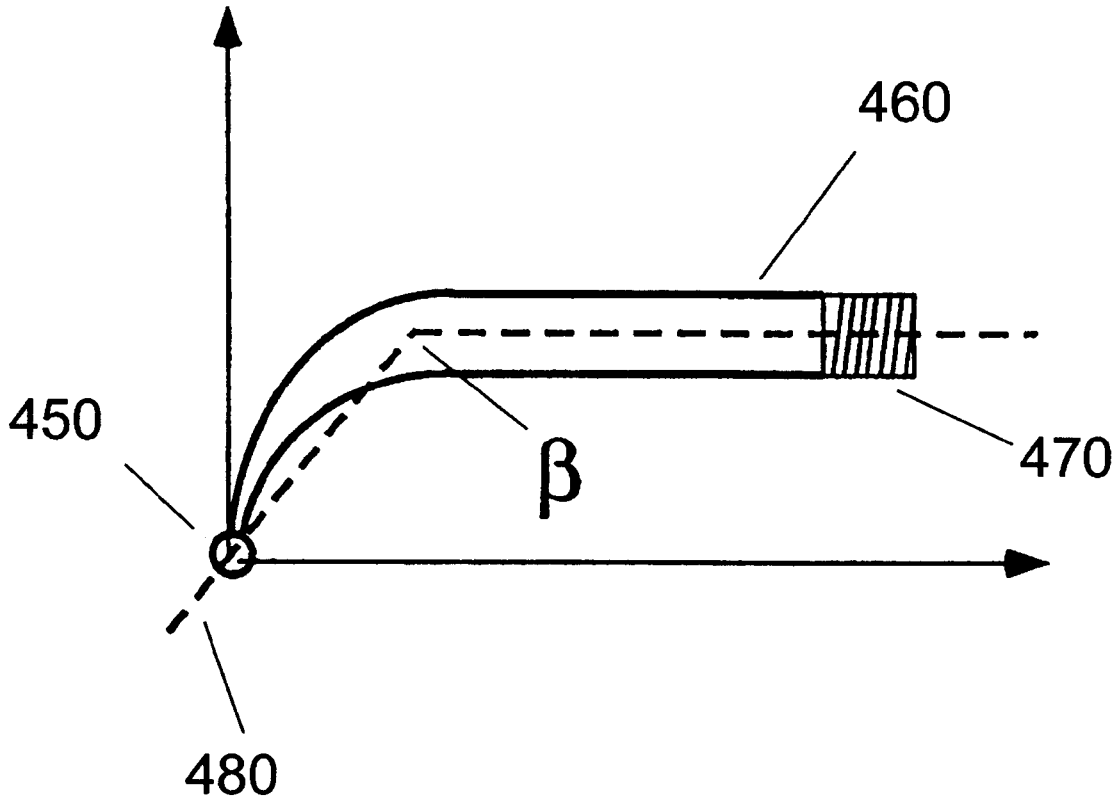

FIG. 3B illustrates yet another embodiment of a tip used in the present invention. The probe 460 has a threaded base 470 and a tip 450 with a spherical end cap. The bend is defined at $\beta$. The angle $\beta$ ranges from approximately 85° to 135°. The overall length of the probe 460 may range from 5 cm to 7 cm. The bend in the tip may begin half-way to two-thirds of the overall probe length. For example, 3 cm to 4 cm with respect to the base 470. The spherical end cap at tip 450 may have a diameter ranging from approximately 1.0 mm to 1.5 mm. The diameter of the base ranges from approximately 3 mm to 5 mm. The depth of the threads ranges from approximately 5 mm to 8 mm. The ultimate thread depth would be dependent upon the thickness of the handle, having compatible threads, receiving the probe 460. In this example embodiment, the bird beak shape approximated by the probe is that of an eagle.

Figure 4A:
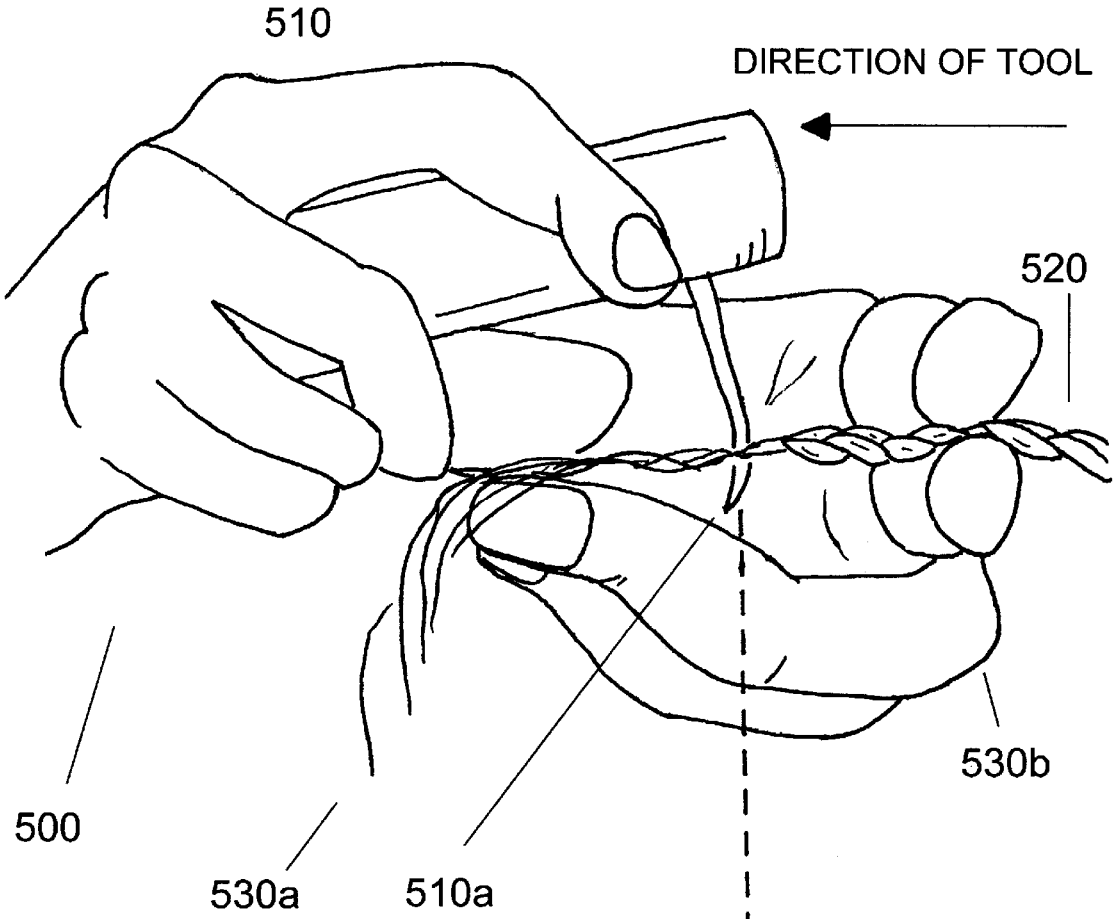
FIG. 4A illustrates in a side view the removal of braids with an example embodiment of the unbraiding tool according to the present invention.

FIG. 4A is a side view of an example embodiment of the present invention as it used to take apart the braid strand 520. The stylist holds the unbraiding tool 510 in one hand 530*a* while grasping the braid strand 520 in the other hand. The probe tip 510*a* is pushed downward into the braid strand 520, separating the braid strand 520. The tool 510 is then pulled toward the end of the braid strand as shown by the arrow.

Figure 4B:
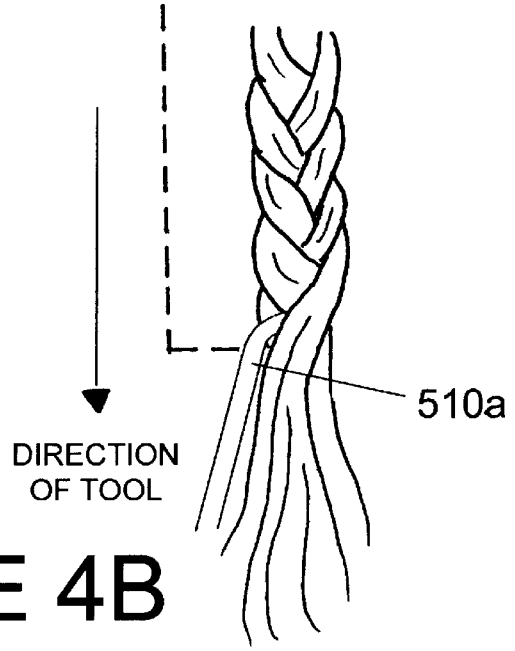
FIG. 4B illustrates in top view the removal of braids with the example embodiment of the present invention of FIG. 4A.

FIG. 4B illustrates a top view of the example embodiment illustrated in FIG. 4A.

The invention can have a multitude of handle and tip designs. Methods for manufacturing the probes and the handles are well known. How a probe is attached to the handle is depends upon the handle and tip materials used. Alternatively, a suitable tip to perform the function unbraiding may be incorporated into multipurpose tools such as multi-blade pocket knives or pliers.

While the present invention has been described with reference to several particular example embodiments, those skilled in the art will recognize that many changes may be made thereto without departing from the spirit and scope of the present invention, which is set forth in the following claims.

What is claimed:

1. A braid unknotting tool comprising:

a cylindrical handle having a length and an outside circumference, a top and a bottom and a side, the length and outside circumference sufficient for a hand to grasp the tool, and the side of the cylindrical handle having screw threads of a first diameter;

a receptacle having a depth, defined within the top of the cylindrical handle, the receptacle having an inside circumference less than the outside circumference of the cylindrical handle, the depth of the receptacle less than the length of the handle, the receptacle having threads defined on the inside circumference of the receptacle;

an end-cap having a circumference and threads corresponding to the threads and inside circumference of the receptacle, enabling the end-cap to screw into the receptacle; and a probe having a base of a first diameter and a tip of a second diameter, the base of the probe having threads corresponding to the first diameter screw threads of the side of the cylindrical handle enabling the base of the probe to screw into the handle, the tip having sufficient taper to penetrate and separate a hair braid strand and sufficient curvature defined in a bend to retain the hair braid strand as the braid unknotting tool is pulled through the hair braid strand.

2. A braid unknotting tool as recited in claim 1 wherein the probe tip has a shape selected from the following: a sphere, a point, and a rectangle.

3. A braid unknotting tool comprising:

a handle having a long side having a length and a short side having a cross-section with a length less than the length of the long side, the long side having sufficient length and cross-section having sufficient breadth for a hand to grasp the tool;

a probe having a tip and a base, the base being attached to the long side of the handle, the tip having sufficient taper to penetrate and separate a hair braid strand and sufficient curvature to retain the hair braid strand as the braid unknotting tool is pulled through the hair; and a storage receptacle defined in the short side of the handle, the storage receptacle having a depth sufficient to accommodate at least one probe.

4. A braid unknotting tool as recited in claim 3 wherein the storage receptacle includes an end-cap to close the storage receptacle.

* * * * *